US008671838B2

(12) United States Patent
Berti et al.

(10) Patent No.: US 8,671,838 B2
(45) Date of Patent: Mar. 18, 2014

(54) METHOD FOR HYBRID INLINE COLOR CONTROL FOR PRINTING PRESSES

(75) Inventors: Christopher Berti, Dielheim (DE); Wolfgang Geiβler, Bad Schönborn (DE); Werner Huber, Wiesloch (DE); Manfred Schneider, Bad Rappenau (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 640 days.

(21) Appl. No.: 12/770,973

(22) Filed: Apr. 30, 2010

(65) Prior Publication Data

US 2010/0275798 A1 Nov. 4, 2010

(30) Foreign Application Priority Data

Apr. 30, 2009 (DE) ..... 10 2009 019 589

(51) Int. Cl.
*B41F 33/00* (2006.01)

(52) U.S. Cl.
USPC ..... 101/484; 101/211

(58) Field of Classification Search
USPC ..... 101/484
See application file for complete search history.

(56) References Cited

U.S. PATENT DOCUMENTS

| | | | | |
|---|---|---|---|---|
| 4,200,932 | A | 4/1980 | Schram et al. | |
| 4,932,320 | A * | 6/1990 | Brunetti et al. | 101/181 |
| 5,182,721 | A * | 1/1993 | Kipphan et al. | 382/112 |
| 5,689,425 | A * | 11/1997 | Sainio et al. | 700/124 |
| 6,192,147 | B1 * | 2/2001 | Bucher et al. | 382/165 |
| 7,000,544 | B2 * | 2/2006 | Riepenhoff | 101/484 |
| 7,398,733 | B2 | 7/2008 | De Vries et al. | |
| 7,426,061 | B2 | 9/2008 | Mimamino | |
| 7,515,267 | B2 | 4/2009 | Ehbets et al. | |
| 7,830,549 | B2 * | 11/2010 | Huber et al. | 358/1.9 |
| 7,884,926 | B2 | 2/2011 | Engler et al. | |
| 7,894,065 | B2 | 2/2011 | Kohlbrenner et al. | |
| 8,503,027 | B2 * | 8/2013 | Huber | 358/1.9 |
| 2003/0210395 | A1 * | 11/2003 | Takahashi et al. | 356/405 |
| 2008/0236430 | A1 | 10/2008 | Elter et al. | |
| 2009/0080009 | A1 * | 3/2009 | Takahashi et al. | 358/1.9 |
| 2012/0073464 | A1 | 3/2012 | Billmaier et al. | |

FOREIGN PATENT DOCUMENTS

| | | | |
|---|---|---|---|
| CN | 1612586 | A | 5/2005 |
| CN | 101032882 | A | 9/2007 |
| CN | 101118222 | A | 2/2008 |
| CN | 101244648 | A | 8/2008 |
| CN | 101279532 | A | 10/2008 |
| DE | 10 2004 021 601 | A1 | 12/2005 |

(Continued)

*Primary Examiner* — Anthony Nguyen
(74) *Attorney, Agent, or Firm* — Laurence A. Greenberg; Werner H. Stemer; Ralph E. Locher

(57) ABSTRACT

A method for color control in printing presses having at least one first color measuring instrument and at least one second color measuring instrument, includes registering at least one first inking zone on a printing material with the first color measuring instrument and registering at least one other, second inking zone on the printing material with the second color measuring instrument. In a first step, a color difference between actual colorations of the first and second inking zones is calculated, in a second step, a color difference between an actual coloration of the first inking zone and a desired coloration of the second inking zone is calculated and, in a further step, the calculated color differences are added and supplied to a color control for the second inking zone.

15 Claims, 3 Drawing Sheets

(56) References Cited

FOREIGN PATENT DOCUMENTS

| | | | |
|---|---|---|---|
| DE | 102007008849 | A1 | 9/2007 |
| DE | 10 2006 014 657 | A1 | 10/2007 |
| EP | 2008818 | A2 | 12/2008 |
| EP | 2 033 789 | A2 | 3/2009 |
| GB | 2000082 | A | 1/1979 |

* cited by examiner

METHOD FOR HYBRID INLINE COLOR CONTROL FOR PRINTING PRESSES

CROSS-REFERENCE TO RELATED APPLICATION

This application claims the priority, under 35 U.S.C. §119, of German Patent Application DE 10 2009 019 589.0, filed Apr. 30, 2009; the prior application is herewith incorporated by reference in its entirety.

BACKGROUND OF THE INVENTION

Field of the Invention

The present invention relates to a method for color control in printing presses having at least one first color measuring instrument and at least one second color measuring instrument, with the first color measuring instrument registering at least one first inking zone and the second color measuring instrument registering at least one other, second inking zone on a printing material.

In order to monitor the printing quality in printing presses, color measuring instruments are used with which printing materials being produced are measured colorimetrically or densitometrically, at least at certain time intervals. The measured results are then compared with the measured color values from the printing original, so that any deviations between the desired coloration of the printing original and the actual coloration of the produced printing materials can be determined. In principle, there are two types of measuring instruments for printing quality monitoring, color measuring instruments in the printing press and color measuring instruments outside the printing press. The color measuring instruments in the printing press have the great advantage that, in theory, any printing material can be registered in the machine, and in that way even short and dynamic deviations from the coloration can be registered reliably. Particularly in the case of sheet-fed offset printing presses, it is possible to monitor the coloration on each printed sheet in that manner. However, because of the high speed of printing, it is practically impossible to measure the entire area of printing materials in the machine by using the current color measuring instruments, since in that case the registration of the entire area of the printing material takes up too much time. For that reason, printing materials are normally only measured in the printing press on a print control strip applied transversely with respect to the transport direction.

In principle, that disadvantage does not occur in the case of color measuring instruments outside the printing press, since in that case the principle necessitates time playing a subordinate role. In the case of those instruments, a proof sheet is taken from the printing press at regular intervals and placed on a measuring table belonging to the color measuring instrument disposed outside the printing press. The entire area of the proof sheet can be registered without difficulty on the measuring table, so that all of the points in the printed image of the proof sheet can also be checked for correct coloration.

In that case, there is the approach of placing two different color measuring instruments in the printing press, firstly a color measuring instrument measuring exactly colorimetrically, with which only individual points or regions of each printing material are registered and which corresponds to the greatest possible extent to the measuring instruments outside the printing press, and secondly a large-area but colorimetrically not absolutely exactly measuring color measuring instrument, such as an RGB camera or a scanner, which additionally registers a large area of the printing material in the printing press. Such a configuration is known from European Patent Application EP 2 033 789 A2. In that case, an RGB camera and a spectral measuring head are used in the printing press, with the measured color values registered over a large area by the RGB camera being corrected through the use of the absolutely exactly registered measured color values from the spectral measuring head for the purpose of calibration. That type of combined color measuring instrument is also designated as a hybrid in-line instrument. However, that instrument has the disadvantage that only one calibration takes place, which is additionally not carried out during each measuring operation.

SUMMARY OF THE INVENTION

It is accordingly an object of the invention to provide a measurement and control method for controlling the color control in printing presses in the case of hybrid inline color measuring instruments, which overcomes the hereinaforementioned disadvantages of the heretofore-known methods of this general type and which also combines advantages of different measuring principles during a measuring operation.

With the foregoing and other objects in view there is provided, in accordance with the invention, a method for color control in a printing press. The method comprises registering at least one first inking zone on a printing material with at least one first color measuring instrument, registering at least one second inking zone on the printing material with at least one second color measuring instrument, calculating a color difference between actual colorations of the first and second inking zones in a first step, calculating a color difference between the actual coloration of the first inking zone and a desired coloration of the second inking zone in a second step, and adding the calculated color differences and supplying the added color differences to a color control for the second inking zone in a third step.

The present invention is suitable in particular for use in sheet-fed rotary printing presses which have printing units with inking units of zonal construction. In this construction, a plurality of inking zones are disposed over the entire sheet width, transversely with respect to the sheet transport direction. For each inking zone, the inking unit has a variable inking zone opening, with which the layer thickness of the ink application can be varied for the respective inking zone. This changing of the ink layer thickness can be achieved, for example, by so-called inking zone slides, which are each driven by an electric motor. In this case, there is an inking zone slide with its own electric motor for each inking zone. The electric motor is in turn monitored by a control computer of the printing press. In this way, up to 32 inking zones are disposed over the entire width of the printed sheet in the case of sheet-fed printing presses with the large 105 format. Accordingly, in order to monitor the printing quality, the coloration must be measured in each inking zone. As already mentioned at the beginning, the spectrophotometers that measure colorimetrically exactly point by point have the great disadvantage that they are able to register only one measured value on each sheet because of the high speed of printing in the printing press. For this reason, in order to register at least one measured point in each inking zone, a configuration having 32 spectrophotometers would be required. Such a configuration would go beyond any tolerable cost framework, meaning that approaches in the direction of a hybrid solution with a further combined color measuring instrument are much more promising. By using an RGB camera, at least relatively small measuring areas on the printing material can be registered over the area. However, RGB cameras have the disadvantage that they measure only relatively exactly colorimetrically and not absolutely exactly colorimetrically. The RGB camera is therefore able to register color changes reliably over time but cannot carry out any reliable comparison with the absolute color values from the printing original. In particular, in the setup phase of the printing press, however, it is important at least to register all of the inking zones on a printing material, since in this case the coloration still varies sharply from sheet to sheet. Therefore, in this case, one measurement per sheet by using a spectral measuring head is inadequate. Of course, however, the present invention can also be used during continuous printing.

The present invention now follows the approach that, with a first color measuring instrument, which measures colorimetrically exactly, a color measuring area is preferably measured in the color measuring strip of the printing material for each color separation, while, at least in the same color separation, a second color measuring area of the color measuring strip is registered by a second, colorimetrically not exactly measuring color measuring instrument, which is an area that does not have to be registered by the first color measuring instrument. In this case, the second color measuring instrument is preferably an RGB camera, which registers a plurality of inking zones simultaneously. The second color measuring instrument preferably registers at least all of the inking zones in the color measuring strip of a printing material. This is possible in particular when the second color measuring instrument registers all of the inking zones of a print control strip applied transversely with respect to the transport direction. The print control strip offers the advantage that it is not necessary to register all of the printed image on the printing material but only a relatively narrow strip, which is preferably applied to the leading or trailing edge of the printing material and which contains at least one color measuring area for each inking zone. Since the at least one second inking zone is not registered by the first color measuring instrument, a method must be provided which, with the aid of the first color measuring instrument, nevertheless permits exact color control for the second inking zone in the inking unit of the printing press.

The following basic preconditions are taken as a basis in this case. For all of the inking zones there is a desired color value, which is preferably a desired colorimetric value. Accordingly, there is also a desired colorimetric value for the second inking zone, which is registered only by the second, colorimetrically not exactly measuring color measuring instrument. Furthermore, in each inking zone the second color measuring instrument registers an actual color value which, because of the construction of the second color measuring instrument, is not colorimetrically exact. Furthermore, on the first inking zone, which is registered by the first, colorimetrically exactly measuring color measuring instrument, a colorimetric actual color value is registered. According to the invention, then, in a first method step, the color difference between the actual coloration of the first and the second inking zone is calculated. This first color difference is stored in a control computer belonging to the printing press. In a second method step, the color difference between the actual coloration of the first inking zone and the desired coloration of the second inking zone is then calculated and stored in the control computer of the printing press as a second color difference. Finally, in a third method step, the calculated first and second color differences are added and this resultant color difference is used for the color control of the second inking zone in the printing press. This means that, in the case of the first inking zone, which is registered by the first color measuring instrument, a desired value/actual value comparison can be performed directly on the basis of colorimetric measured color values while, for all of the other inking zones, which are registered only by the second color measuring instrument, the method according to the invention is used, in order, with the aid of the colorimetric measured color values from the first inking zone, also to be able to subject the second and further color measuring zones, which are not registered by the first color measuring instrument, to the most exact colorimetric control possible.

In accordance with another mode of the invention, the color difference calculated in the first step is to be calculated in the color space of the second color measuring instrument, and the color difference calculated in the second step is to be calculated in the color space of the first color measuring instrument. In this case, the color space of the first color measuring instrument is preferably the Lab color space, and the color space of the second color measuring instrument is the RGB color space. This arises from the fact that the first exact color measuring instrument used is preferably a spectral measuring head, which uses the Lab color space, and that the second, colorimetrically not absolutely exactly measuring color measuring instrument used is an RGB camera, which uses the RGB color space. This means that, in the first method step, the color difference from the actual colorations between the first and the second inking zone is calculated in the RGB color space. By contrast, the color difference calculated in the second step between the actual coloration of the first inking zone and the desired coloration of the second inking zone is calculated in the Lab color space.

Preferably, in the calculation of the second method step, use is made of ink models known from colorimetric control. These ink models are prior art.

In accordance with a further mode of the invention, in setup operation, the first and the second inking zone are chosen in such a way that the color difference in the color space of the second color measuring instrument is as small as possible and that, in addition, the color difference between the actual colorimetric value of the spectrally measured inking zone and the desired colorimetric value of the non-spectrally measured inking zone is as large as possible. In this case, changes are made on the exact, spectrally defined, colorimetric side in the Lab color space and the approximations on the RGB side in the RGB color space are minimal.

In accordance with a concomitant mode of the invention, the first color measuring instrument can be disposed both in the printing press and outside the printing press. However, the configuration within the printing press is preferred. In this case, both measuring instruments can be accommodated in the same printing unit/varnishing unit or in different units.

Other features which are considered as characteristic for the invention are set forth in the appended claims.

Although the invention is illustrated and described herein as embodied in a method for hybrid inline color control for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
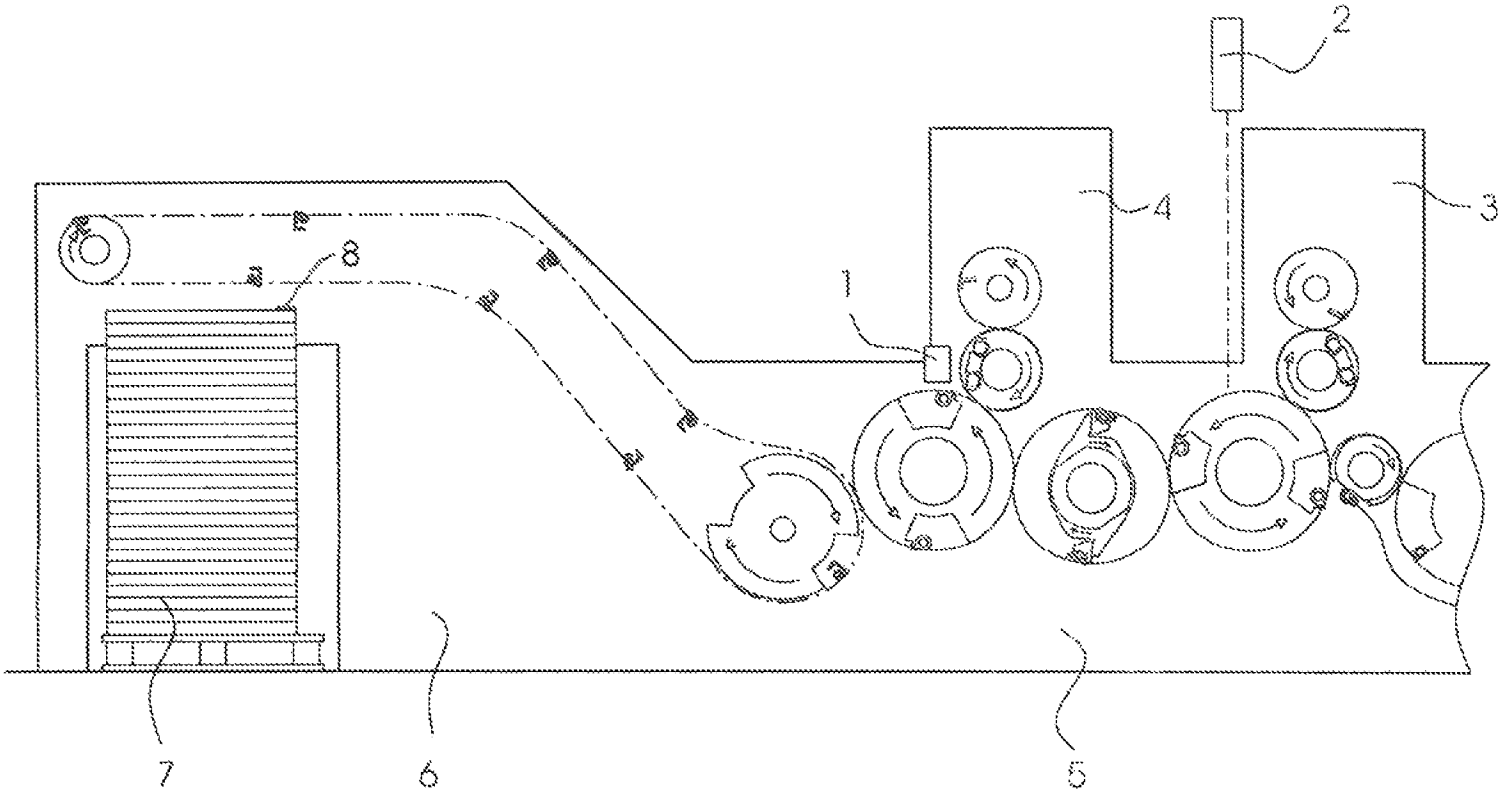
FIG. 1 is a fragmentary, diagrammatic, longitudinal-sectional view of a sheet-fed printing press with a spectral measuring head disposed in the printing press and an RGB camera disposed in the printing press.

Referring now to the figures of the drawings in detail and first, particularly, to FIG. 1 thereof, there is seen a diagrammatic illustration of a printing press 5 which has printing units 3 and a varnishing unit 4. For improved clarity, only one printing unit 3 is depicted but, of course, the printing press 5 normally has a plurality of printing units for various printing inks. In addition, a varnishing unit 4 is additionally shown after the last printing unit 3. The varnishing unit 4 varnishes over applied ink layers on printing materials 7 printed in the printing press 5. The printing materials 7 produced in this way are then deposited on a stack in a delivery 6 at the end of the printing press 5. An RGB camera 2, which is mounted in the last printing unit 3 of the printing press, registers at least one print control strip 8 applied to the printing material 7 at the leading and/or trailing edge of the sheet, for each of several inking zones m, n which are present therein. In addition, a spectral measuring head 1, which is mounted in the varnishing unit 4, registers only one inking zone m in the print control strip 8 on each printing material 7. This means that at least one inking zone m in the print control strip 8 is registered both by the RGB camera 2 and by the spectral measuring head 1.

Figure 2:
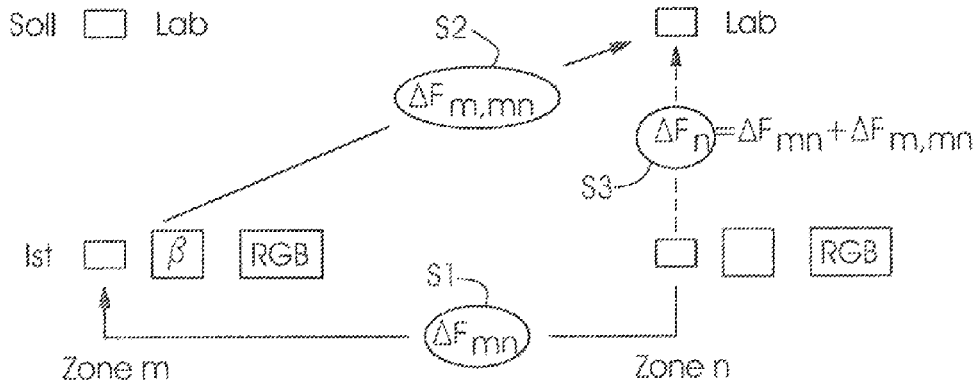
FIG. 2 is a flow chart showing three important method steps for calculating color deviations in inking zones measured only with an RGB camera.

FIG. 2 illustrates a basic computational path of three method steps needed for a color measuring area of a color separation in the print control strip 8. For complete color control, the method must be applied to color measuring areas of all of the color separations in the inking zones m, n. By way of example in this case, two color measuring areas from the same color separation in different inking zones m, n in the print control strip 8 on a printing material 7 are depicted. While the inking zone m is registered both by the spectral measuring head 1 and by the RGB camera 2, the inking zone n is registered only by the RGB camera 2. This means that, for the inking zone n, only relatively exactly measured, measured color values are present while, for the inking zone m, absolutely exactly measured, measured color values are present. It can be seen that, in a method step S1, firstly a color difference $\Delta F_{mn}$ between the spectrally measured inking zone m and the non-spectrally measured inking zone n is calculated in the color space of the RGB camera 2. This is done on the basis of the non-spectrally measured actual color values registered by the camera 2. In a second method step S2, a color difference $\Delta F_{n,nm}$ between the actual colorimetric value registered by the spectral measuring head 1 in the spectrally measured inking zone m and the desired colorimetric value of the non-spectrally measured inking zone n is then calculated. This calculation takes place in the Lab color space of the spectrophotometer 1. In a third and last step S3, the two color differences S1 and S2 are then added and yield a color difference $\Delta F_n$ in the non-spectrally measured inking zone n. These calculation steps must be carried out for each of the non-spectrally measured inking zones n on the printing material 7.

In the case of large-format sheets, there are usually 32 inking zones on the printing material 7. There are one or more color measuring areas in the print control strip 8 for each of the 32 inking zones. With the present method, only one of the 32 inking zones is registered by the spectral measuring head 1, while all 32 inking zones are registered by the RGB camera 2. In this case, the three method steps according to the invention must then be carried out for the 31 inking zones which are registered only by the RGB camera 2. These method steps can be carried out on a non-illustrated control computer belonging to the printing press 5, to which both the spectral measuring head 1 and the RGB camera 2 are connected. This control computer then in turn calculates the necessary adjustment parameters for the inking units in the printing units 3 of the printing press 5 on the basis of the color differences determined by the three method steps in the non-spectrally registered inking zones n. In this way, a closed color control loop can be created for all 32 inking zones, with only one of the 32 inking zones having to be registered colorimetrically absolutely exactly through the use of the spectral measuring head 1, while the other 31 inking zones are registered only by the camera 2. Despite this, because of the method steps according to the invention, colorimetrically absolutely exact color control is also possible in these inking zones n. Therefore, the use of many expensive spectral measuring heads 1 for each inking zone n can be avoided.

Figure 3:
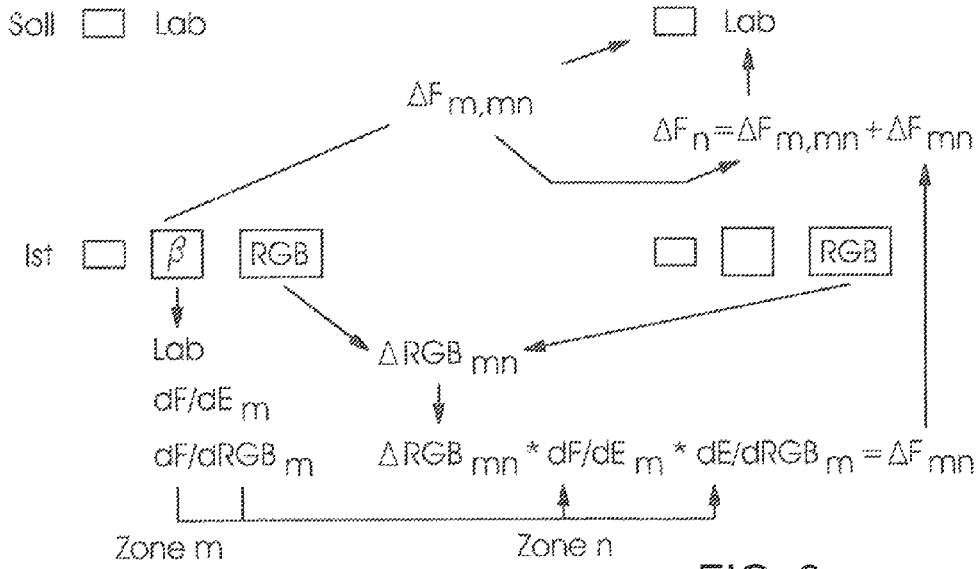
FIG. 3 is a flow chart showing a scalar computational path.

FIG. 2 illustrates the basic computational path. It must now be explained exactly how the color differences $\Delta F_{mn}$ and $\Delta F_{m,mn}$ are calculated. FIG. 3 explains this by way of example for a setup phase. The color difference $\Delta F_{m,mn}$ is calculated in a known way through the use of an ink model. The details of this ink model have been known for years under the keyword "colorimetric control" and are prior art. The defining equation specified in FIG. 2 applies correspondingly for the color difference $\Delta F_{mn}$.

$\Delta RGB_{mn}$: this is the Euclidian distance between the two actual colorations of the zones m and n in the RGB color space.

$dF/dE_m$: this scalar is the ratio between a color change dF and a coloration or inking change dE calculated from the spectral data of the zone m.

To this end, by using the ink model mentioned, a defined layer thickness change (in this case 1%) is simulated spectrally and the Euclidian spacing between the resultant color locus and the original color locus is calculated (=dE).

$dE/dRGB_m$: this is the ratio metric of the color spaces Lab and RGB along the line of coloration of the color of the selected color separation.

Figure 4:
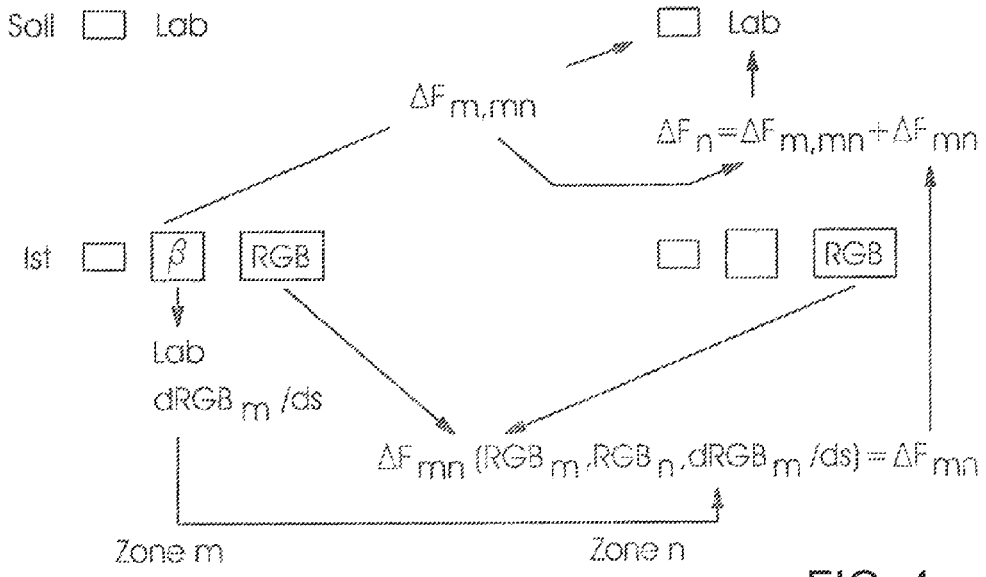
FIG. 4 is a flow chart showing a vector computational path.

The computational path from FIG. 3 is the scalar variant of the process. FIG. 4 reveals a vectorial process. The method steps differ in that, to calculate $\Delta F_{mn}$, a so-called sensitivity is used directly.

The sensitivity is the tangent to the line of coloration at the respective color locus, normalized to a percentage layer thickness change. In practical terms, the sensitivity in the RGB space of the coloration of the zone m, expressed pictorially as $RGB_m$, is extended until the resultant target color locus is located optimally close to the (desired) color locus $RGB_n$. The color difference is calculated directly from the length ratio target color locus—actual color locus to the length of the sensitivity. An advantage of this variant is that the RGB color loci of the two zones n and m do not have to lie on the same line of coloration, which also takes measuring tolerances into account. If this is so, then there are necessarily differences in coloration which cannot be controlled out, that do not make the color control worse in the case of the vectorial variant.

Figure 5:
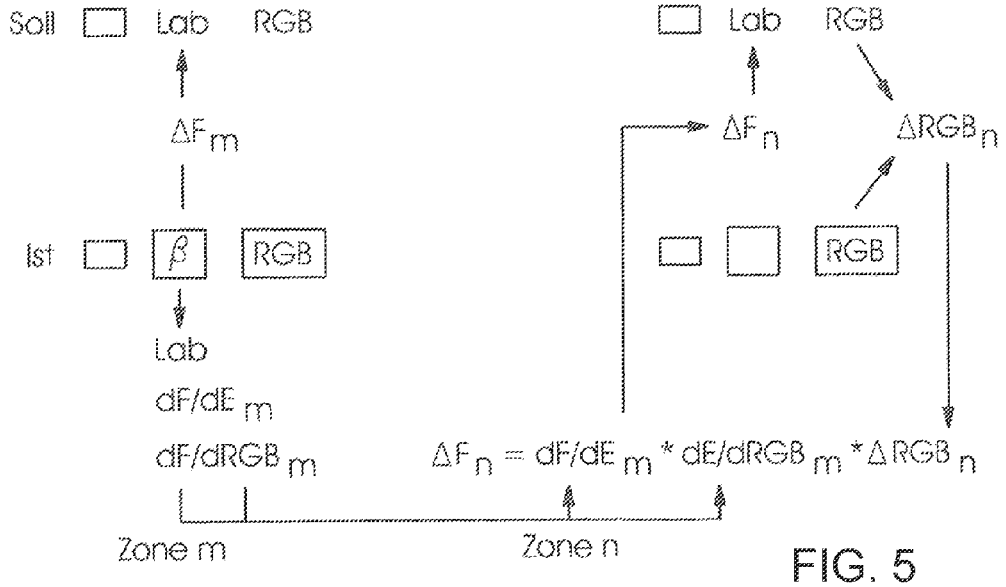
FIG. 5 is a flow chart showing use of the method according to the invention in continuous printing.

In continuous printing after the OK sheet, there are desired RGB values present for all of the zones. Furthermore, the color errors occurring in the process are small, since the system, above all the camera 2, measures and controls out the deviations in coloration continuously. The method can therefore be modified for continuous printing in accordance with FIG. 5. It is possible for both the scalar and the vectorial variants to be chosen and in both cases, the additional step for the calculation of $\Delta F_{m,mn}$ is dispensed with.

In all of the variants mentioned, the use of a database is possible which, for example, can be stored in the control computer of the printing press 5. Factor metrics or sensitivities obtained once can then be stored in the database in order to accelerate the control process. Therefore, the setup process can be started, supported merely by camera data. Of course, the data for color control from the currently running printing operation are preferably used.

It is also possible to use an online spectrophotometer, which is connected to the camera 2, outside the printing press 5. During the technical implementation, a spectrophotometer 1 integrated into the printing press 5 was previously described. It is also conceivable to carry out the described methods with a spectrophotometer not located in the printing press 5.

The RGB color difference can also be calculated through the use of the ink density. Although this variant is inferior to the one specified above, it is in principle possible. For this purpose, the RGB density is formed: $D_{RGB}=-\log(F/F_{pw})$, with F as the color value of the filter complementary to the color and $F_{pw}$ the same as for paper white. As an example, F for the color cyan would be the camera channel of the red filter R. Since the spectral value functions of the camera 2 correspond most closely to the DIN (German Industrial Standards) broadband filters, it would therefore be simple to calibrate to this standardized filter standard in a known way. The calculation of the color difference from the density difference can be carried out in a known way, either through the percentage ratio of the two densities or through a spectrally calculated density sensitivity.

The invention claimed is:

1. A method for color control in a printing press, the method comprising the following steps:

registering at least one first inking zone on a printing material with at least one first color measuring instrument;

registering at least one second inking zone on the printing material with at least one second color measuring instrument;

in a first step, calculating a color difference between actual colorations of the first and second inking zones;

in a second step, calculating a color difference between the actual coloration of the first inking zone and a desired coloration of the second inking zone; and in a third step, adding the calculated color differences resulting in added color differences and supplying the added color differences to a color control for the second inking zone.

2. The method according to claim 1, which further comprises calculating the color difference calculated in the first step in a color space of the second color measuring instrument, and calculating the color difference calculated in the second step in a color space of the first color measuring instrument.

3. The method according to claim 1, wherein the first color measuring instrument measures colorimetrically absolutely.

4. The method according to claim 1, wherein the second color measuring instrument measures colorimetrically non-absolutely.

5. The method according to claim 3, wherein the first color measuring instrument is a spectral color measuring instrument.

6. The method according to claim 4, wherein the second color measuring instrument is an RGB camera.

7. The method according to claim 1, wherein the first color measuring instrument measures colorimetrically absolutely, the second color measuring instrument measures colorimetrically non-absolutely, the first color measuring instrument is a spectral color measuring instrument, and the second color measuring instrument is an RGB camera.

8. The method according to claim 1, wherein the second color measuring instrument is disposed in the printing press.

9. The method according to claim 8, wherein the first color measuring instrument is disposed in the printing press.

10. The method according to claim 8, wherein the first color measuring instrument is disposed outside of a printing unit of the printing press.

11. The method according to claim 2, wherein the color space of the first color measuring instrument is a Lab color space, and the color space of the second color measuring instrument is an RGB color space.

12. The method according to claim 1, wherein the first and second inking zones are color measuring areas in a print control strip disposed on the printing material.

13. The method according to claim 1, wherein the desired measured color value for the second inking zone is a colorimetric measured color value.

14. The method according to claim 1, which further comprises calculating the color difference in the second step through the use of an ink model.

15. The method according to claim 1, which further comprises, in a setup operation, choosing the first and second inking zones in such a way that a color difference in a color space of the second color measuring instrument is as small as possible and a color difference between an actual colorimetric value of a spectrally measured inking zone and a desired colorimetric value of a non-spectrally measured inking zone is as large as possible.

* * * * *